United States Patent [19]

Olson

[11] Patent Number: 4,489,640

[45] Date of Patent: Dec. 25, 1984

[54] DOOR OPERATING APPARATUS

[75] Inventor: Paul E. Olson, Lexington, Ky.

[73] Assignee: American Standard Inc., Lexington, Ky.

[21] Appl. No.: 470,415

[22] Filed: Feb. 28, 1983

[51] Int. Cl.[3] ..... F01L 15/20

[52] U.S. Cl. ..... 91/189 R; 92/136; 49/255; 49/334; 16/56; 16/58; 16/DIG. 9

[58] Field of Search ..... 92/2, 136; 91/189 R; 49/334, 255; 16/56, 58, 62, 64, 69, 79, DIG. 9, DIG. 17, DIG. 20

[56] References Cited

U.S. PATENT DOCUMENTS

| | | | |
|---|---|---|---|
| 3,299,782 | 1/1967 | Sunday | 91/189 |
| 3,346,992 | 10/1967 | Lodge | 49/255 |
| 3,751,995 | 8/1973 | Carlson | 49/255 |
| 3,888,045 | 6/1975 | Piegza | 49/334 |
| 3,941,033 | 3/1976 | Olsen | 91/189 R |
| 4,006,664 | 2/1977 | Brown | 91/189 R |
| 4,115,897 | 9/1978 | Zunkel | 16/79 |
| 4,186,911 | 2/1980 | Huet et al. | 92/2 |
| 4,282,686 | 8/1981 | Britzke et al. | 49/334 |
| 4,308,691 | 1/1982 | Horn | 49/334 |

FOREIGN PATENT DOCUMENTS

| | | | |
|---|---|---|---|
| 2329263 | 12/1974 | Fed. Rep. of Germany | 49/255 |

*Primary Examiner*—Michael Koczo
*Assistant Examiner*—Randolph A. Smith
*Attorney, Agent, or Firm*—A. G. Williamson, Jr.

[57] ABSTRACT

A piston and geared rack assembly are moved by pressurized air in opposite directions within a power cylinder housing as the vehicle operator registers door closing and opening commands in a solenoid valve. This lateral movement is converted to rotary movement by a pinion gear driven by the rack and coupled to turn a spindle shaft which drives the door. At full stroke during door closing, the power piston actuates a valve to charge the lower chamber of an auxiliary cylinder to move a lift piston rod, movable within the spindle shaft, to raise the closed door into a locked position. Upon a door-open command, the solenoid valve exhausts the charged cylinder chambers, admits air into the upper chamber of the auxiliary cylinder to move the lift piston and rod to lower and release the door, and slowly charges the associated opening chamber. This enables the delayed movement of the power piston and rack assembly in the opposite direction, reversing the rotation of the pinion and spindle shaft, to open the door. If air pressure is lost with the door closed and locked, the weight of the door forces the lift piston and rod down, releasing the door from its locked position for emergency manual operation.

8 Claims, 6 Drawing Figures

DOOR OPERATING APPARATUS

FIELD AND BACKGROUND OF THE INVENTION

My invention relates to vehicle door operating apparatus. More particularly, the invention pertains to apparatus to close and open a vehicle door through a spindle drive and rod arrangement and using a lift motion to seal and lock the closed door.

It is known to use a pneumatically powered rotary actuator connected by rods and levers to rotate a door spindle to open and close vehicle doors, particularly the two-part doors on transit buses. However, most known arrangements do not provide effective door sealing when in the closed position. Looseness of the doors and the associated equipment tends to develop after a short term of use of the vehicle. This results in considerable rattling noise and loss of heated or cooled air during corresponding seasons. There is thus a need for door control apparatus which will provide positive door movement in both opening and closing actions, a better sealing and locking or latching of the closed door, and yet allow release of the locked door if pneumatic power, e.g., air pressure, to actuate the door controller is lost. This feature is necessary to permit a manual opening of the door in the absence of pressurized air, especially during emergency conditions.

Accordingly, an object of my invention is an improved door operating apparatus which provides positive movement of the doors, in both closing and opening directions, and a secure sealing and locking of the closed doors.

Another object of the invention is a pneumatic door actuator to open and close a vehicle door with a positive sealing and locking in the closed door position.

A further object of the invention is a door operating apparatus in which a rack and pinion movement is driven by a pneumatically actuated piston to develop reversible rotary motion which is transmitted to open and close the doors, and to open a valve at the end of a closing stroke of the piston to power a lifting cylinder to lock and seal a closed door.

Yet another object of my invention is door operating apparatus including a rack and pinion arrangement actuated by pressurized air to provide a rotary motion to drive the door to its closed and open positions, further including an integral pneumatic cylinder which provides a lifting force to move a closed door into a locked and sealed condition, so that loss of air pressure releases the door from the locked condition for manual movement during emergency operations.

A still further object of my invention is a rack and pinion assembly, powered by a pneumatically operated piston, which converts linear piston motion into a rotary motion and is coupled to move a vehicle door between its open and closed positions, and an associated lift rod, powered by another piston operated by pneumatic pressure provided through a valve actuated by the rack piston at its full closing stroke, which lifts a closed door to a locked and sealed position held during vehicle movements.

Other objects, features, and advantages of my invention will become apparent from the following specification and appended claims when taken in connection with the accompanying drawings.

SUMMARY OF THE INVENTION

The door operating apparatus of the invention, for a single vehicle door or for each section of a dual door, includes a rack and pinion assembly or set in which the rack is formed as an extension on a piston which slides within a power cylinder formed by the apparatus housing. Movement of the piston and rack unit in a linear direction causes the pinion gear to convert the motion to rotate a spindle shaft to which the operating rod and spindle mechanism of the door is slidably keyed. Pressurized air is admitted to the operating or power cylinder chamber on one side or the other of this piston to cause the opposite direction movements which will close and open the associated door. At the full stroke of the piston movement during the closing operation, the piston engages and actuates a lift and lock valve which admits pressurized air into a lower chamber of an auxiliary or lifting cylinder to move upward a second piston which forms the lower end of a freely movable inner portion of the spindle shaft. When the second piston moves up, it raises this inner or lift rod portion of the shaft to lift the operating assembly of the door, and thus the door, into a sealing position in which the door is locked or latched. The air pressure is maintained in both cylinders to hold the door closed and locked during vehicle movement. When the door is to be opened, the air is exhausted from the lower chamber of the lift cylinder and admitted to a chamber above the lift piston to force that piston down and thus release and lower the door from its seal and lock position. Air is also exhausted from the one end of the power cylinder and, with some restriction to delay response, is supplied to the power cylinder chamber on the other side of the piston and rack element which moves back, rotating the pinion, and thus the spindle shaft, in the opposite direction to open the door. If the air pressure fails for any reason with the door in its locked position, the lift cylinder piston falls under the weight of the door which lowers or drops to its unlocked position in which it may be manually operated in an emergency.

BRIEF DESCRIPTION OF THE DRAWINGS

Before defining my invention in the appended claims, I will describe in detail a specific arrangement of the door operating apparatus embodying the invention, as illustrated in the accompanying drawings, in which:

In each of the drawings, similar reference characters designate the same or similar parts of the apparatus.

DESCRIPTION OF THE ILLUSTRATED EMBODIMENT

Figure 1A:
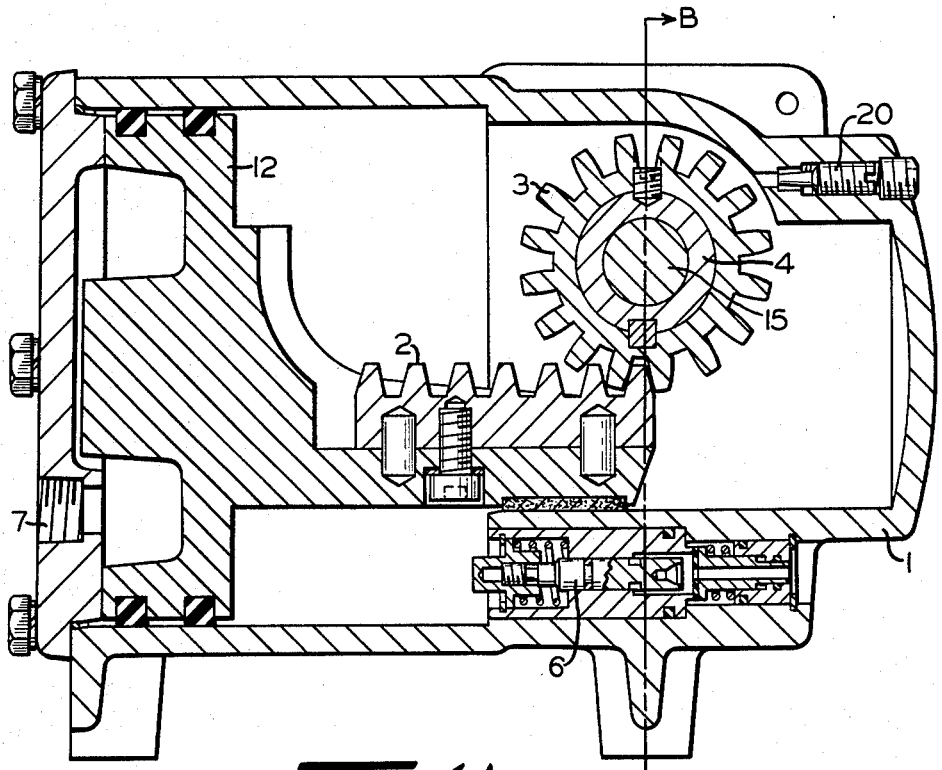
FIG. 1A is a plan view of the door operating apparatus in cross-section along a horizontal center line.
Figure 1B:
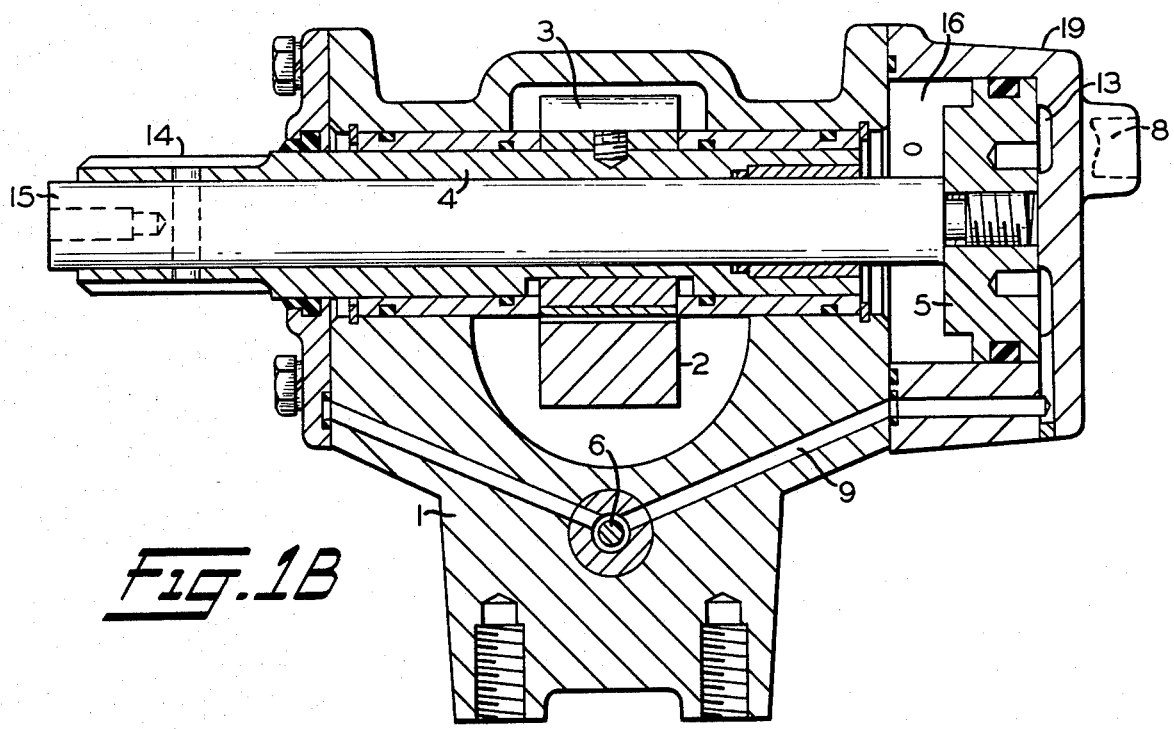
FIG. 1B is a vertical cross-section view taken along the line B—B of FIG. 1A.
Figure 2A:
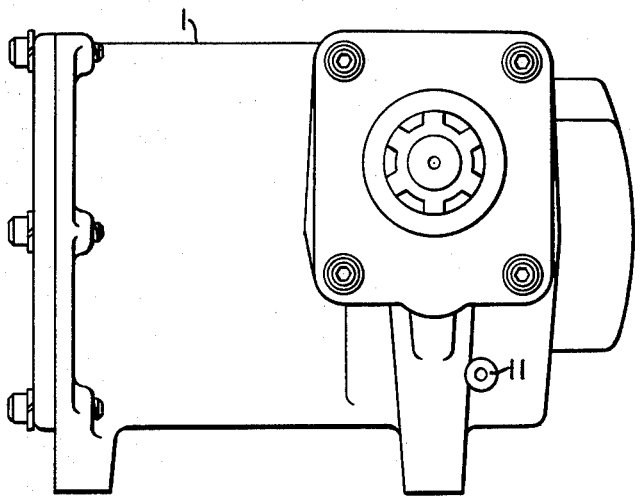
FIGS. 2A, 2B, and 2C are outline drawings illustrating plan, front, and end views, respectively, of the door operating apparatus shown in detail but to a different scale in FIGS. 1A and 1B.
Figure 2B:
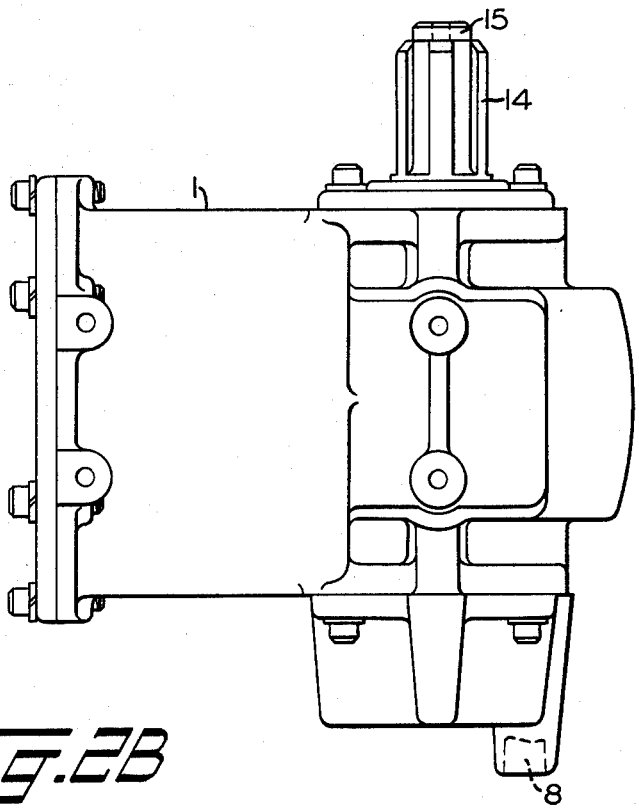
Figure 2C:
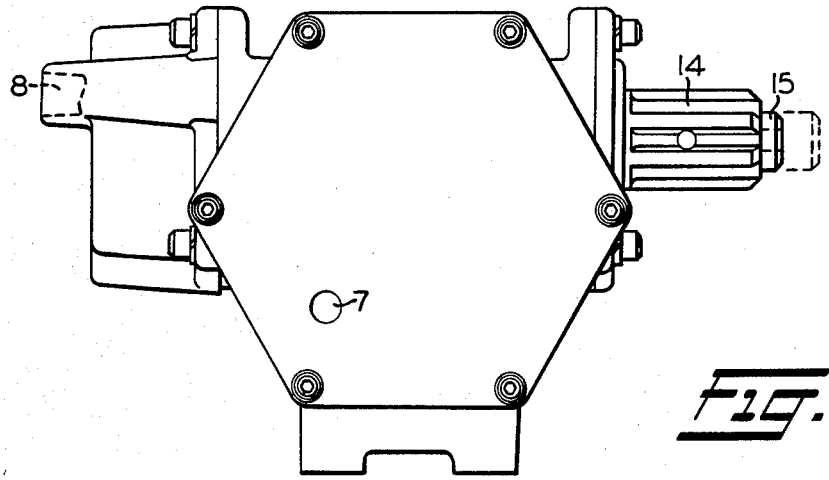

Referring to FIG. 1A, there is illustrated a plan view of the apparatus in cross-section approximately along a horizontal center line of the door operating apparatus. The apparatus includes a housing 1 which forms a cylinder chamber and provides sealing and bearing surfaces for a piston 12 and a rack 2 which move as a unit assembly with linear motion left or right in accordance with the side of the piston to which the pressurized air is applied. The rack 2 engages a pinion gear 3 to convert the linear motion to a rotary motion for the spindle shaft 4 to which the pinion is fastened. Shaft 4 is beter shown in FIG. 1B which is a vertical cross-section along the line B—B in FIG. 1A. The end of shaft 4 which is external to the housing is fitted with a slidable keying element 14, which is specifically shown in FIGS. 2B and 2C of the outline drawings as a spline 14. The operating rod and spindle mechanism for the door are slidably coupled to element 14 which transmits the rotary motion of shaft 4 to the door rods to open and close the door, yet allows the operating rod to slide up and down to lock and unlock the door. This is not specifically shown since these details are not part of my invention. A piston rod 15 is slidably positioned within and along the center line of shaft 4 as indicated in FIG. 1B. This rod is freely movable through an upward stroke of length indicated by the dotted portion at the right of FIG. 2C. At its lower end (right in FIG. 1B), rod 15 is coupled to a piston 5 which is within and movable through the upper chamber 16 of an auxiliary or lift cylinder 19 attached to housing 1 at this right-hand location in FIG. 1B. Pressurized air is admitted by a valve assembly 6 through a passage 9 into a lower chamber 13 of this lift cylinder below piston 5 so that lift rod 15 is raised to lift the door into a locking and sealing position. Valve 6 is actuted by the power piston 12 at the end of its closing stroke when the inner face of the piston engages a stem of valve 6 causing the valve to move and open an external port 11 into the passage 9. This valve is spring-loaded to a closed position in which passage 9 is cut off from port 11. The location of valve 6 and its port 11 is also indicated in FIG. 2A where the external connection of port 11 is illustrated. The lift cylinder housing 19 with piston 5 and chambers 13 and 16 is a separate attachment which may be positioned at either side of the housing 1 (FIG. 1B) to reverse the direction of movement of rod 15 and thus the orientation of shaft 4 and spline 14 to enable individual control of both right-hand and left-hand doors of a two-door unit for a vehicle. Although only the single arrangement is shown in FIG. 1B, those skilled in associated arts will understand without further explanation this reversal of the movement of the pinion gear and shaft and lifting rod assembly.

Figure 3:
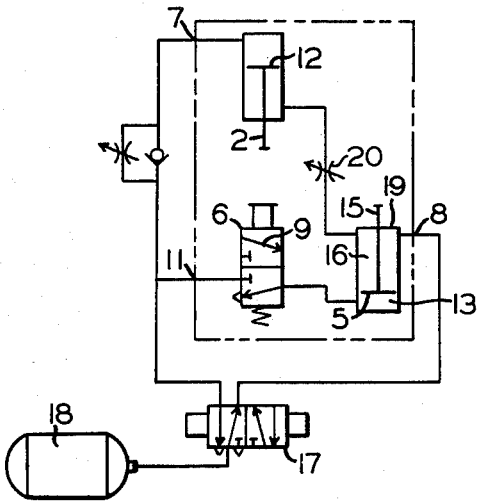
FIG. 3 is a conventional schematic illustration of the pneumatic arrangement for controlling the door operating apparatus illustrated in the other drawings.

Referring now to FIG. 3, there is illustrated a conventional schematic diagram showing the pneumatic connections for supplying pressurized air to the door controller and illustrating the flow of air within the apparatus. The various cylinders, pistons, and valve units there are within the apparatus, that is, the various elements shown in the parts of FIGS. 1 and 2, are illustrated within the dot-dash rectangular block in FIG. 3. A solenoid valve that is controlled by the vehicle operator is illustrated by the symbol 17 with its air passages illustrated in a conventional manner. A source for the pressurized air is represented by the conventionally shown reservoir 18. The apparatus is shown in its condition with the door open, that is, valve 17 in its right position and air from reservoir 18 flowing to and through port 8 into the upper chamber 16 of the lift cylinder and thence through a variable orifice 20 into the inner chamber of the power cylinder to move piston 12 to the left (FIG. 1A) and thus the rack and pinion arrangement into the door-open position. Variable orifice 20, shown in FIG. 1A, retards the flow of air to delay the response of piston 12 until the door has been unlocked and fully released. At this time, ports 7 and 11 are connected through valve 17 to an exhaust port and thus to atmosphere. With valve 6 not engaged by piston 12, chamber 13 below piston 5 exhausted, and chamber 16 charged, rod 15 is in its lower or door-unlocked position so that the door is free to move. It is to be noted that when valve 17 is actuated to the left, upon a request for the door to be closed, port 8 is connected through the valve passages to an atmospheric exhaust port and reservoir 18 is connected to ports 7 and 11. The power cylinder is thus charged so that piston 12 and rack 2 move to close the door. At completion of its movement, piston 12 engages valve 6, and actuates it to its other (open) position. Air from port 11 then flows into the lift cylinder chamber 13 through channel 9 so that piston 5 is raised and in turn raises rod 15 to lock and seal the fully closed door.

In discussing the operation of the apparatus, it is assumed that the door operating apparatus is positioned as shown in the parts of FIG. 1, that is, with the door open. As previously mentioned, this is also the condition illustrated in FIG. 3. The operator actuates valve 17 (FIG. 3) to close the door. Valve 17 moves to the left and couples reservoir 18 to ports 7 and 11 although port 11 is at this moment blanked at valve 6. In FIG. 1A, pressurized air enters ports 7 and piston 12 is forced to the right moving rack 2. This causes pinion 3 and shaft 4 to rotate counterclockwise. The rotation of shaft 4 and thus of spline 14 drives the door closed. As illustrated in FIG. 3, piston 12 and rack 2 move down through the power cylinder block. At the point that the door closes, piston 12 engages the operating mechanism of valve 6 which is then actuated to admit pressurized air from port 11 through channel 9 to chamber 13 below piston 5. In FIG. 3, valve 6 is symbolically shown as shifting its channels to connect chamber 13 of lift cylinder 19 to port 11 and to block off the exhaust. Piston 5 and thus lift rod 15 move up, with the length of stroke illustrated in FIG. 2C, to lift the door into its locked and sealed position. Valve 17 holds in its left position and the power cylinder and lift cylinder chambers remain energized, that is, remain charged with pressurized air to hold in their closed and locked door positions.

When the door is to be opened, the operator actuates valve 17 to its right position, that is, the one shown. This supplies pressurized air to port 8 and immediately exhausts the lift cylinder chamber 13 and the power cylinder outer chamber. Air flows through port 8 into chamber 16 and forces piston 5 and rod 15 quickly to their lower position to unlock and release the door into its lower position. Air from port 8 also flows through chamber 16 and adjustable orifice 20 into the inner chamber at a controlled rate so that sufficient time is available to unlock and fully release the door before piston 12 moves to the left (FIG. 1A) so that rack 2 follows, rotating pinion 3 and shaft 4 clockwise to open the door. It is to be noted that, if the air pressure is lost while the door is closed, so that no power is available to operate the door, the loss of pressure in the lift cylinder chamber 13 releases the door which drops into its lower position, restored by the weight of the door itself, so that it may be opened manually in an emergency.

The apparatus of my invention thus provides positive and vital control for vehicle doors, particularly for transit-type buses. It provides a locking and sealing of closed doors for safety, comfort, and noise reduction. If air pressure is lost, the apparatus releases the locked door so that it may be manually opened in an emergency. The control by the vehicle operator is simple, through a conventional solenoid valve. The resulting door operating apparatus is thus economical and efficient.

Although I have herein shown and described but a single embodiment of the door operating apparatus including my invention, it is to be understood that various changes and modifications therein may be made within the scope of the appended claims without departing from the spirit and scope of my invention.

Having thus described the invention, what I claim as new and desire to secure by Letters Patent, is:

1. Door operating apparatus, for controlling the opening and closing of a vehicle door, comprising:

(a) a housing including a first cylinder chamber, (b) a piston and rack assembly within said first chamber and movable in both directions therein, (c) a pinion and associated shaft coupled for moving said door and controlled by said piston and rack assembly for rotating in opposite directions to close and open said door as said rack moves in one or the other direction, respectively, (d) means for supplying a source of pressurized fluid coupled to said first chamber for selectively moving said piston and rack assembly in said one and other directions, (e) an auxiliary housing with a cylinder chamber coupled to said housing, (f) a lift piston and rod assembly having the piston portion positioned within said auxiliary housing cylinder chamber to respond to pressurized fluid, (1) the rod portion colocated within said pinion shaft, movable longitudinally with respect thereto, and coupled to said door, (g) valve means coupling said auxiliary cylinder to said source and controlled by said piston and rack assembly for supplying pressurized fluid to said auxiliary cylinder chamber when said piston and rack assembly completes a full stroke when closing said door, and (h) said lift piston and rod responsive to the pressurized fluid supplied to said auxiliary cylinder chamber for raising said rod and said door into a lock position.

2. Door operating apparatus as defined in claim 1 in which, said auxiliary housing is positioned on said housing to match the direction of rotation of said pinion and shaft during closing and opening movements of said piston and rack assembly to either portion of a two-section vehicle door with opposing movements.

3. Door operating apparatus as defined in claim 2 in which, said valve means is a spring-loaded, normally closed valve engaged and actuated by said piston and rack assembly at its full stroke position during a door-closing operation for admitting pressurized fluid into said auxiliary cylinder to raise and lock said closed door.

4. Door operating apparatus as defined in claim 3 in which, (a) said auxiliary cylinder includes an upper and a lower chamber positioned above and below said lift piston, respectively, (b) said lift rod is positioned along the longitudinal center line within, and is freely movable with respect to, said pinion shaft, (c) said lift rod is actuated by said lift piston to raise the closed door into its locked position when pressurized fluid is selectively admitted into said auxiliary cylinder lower chamber by said valve when actuated, and (d) said lift rod is actuated by said lift piston to lower said door to its released position when pressurized fluid is selectively admitted into said auxiliary cylinder upper chamber to enable a door opening movement controlled by said piston and rack assembly.

5. Door operating apparatus as defined in claim 4 in which, said lift piston and rod assembly is actuated by the weight of the closed door in response to the loss of pressurized fluid in said auxiliary cylinder lower chamber for lowering and releasing said door for a manual emergency opening operation.

6. Door operating apparatus as defined in claim 5 which further includes, (a) selector means operable to first and second positions to control closing and opening said door, respectively, and in which, (b) said selector means in said first position coupling said source for supplying pressurized fluid to said first cylinder to actuate closing of said door and to said auxiliary cylinder lower chamber when said valve is actuated, (c) said selector means in said second position coupling said source for supplying pressurized fluid to said auxiliary cylinder upper chamber to unlock and release said door and to said first cylinder to actuate opening said door.

7. Door operating apparatus as defined in claim 6 which further includes, a variable orifice device coupling said source to said first cylinder when said selector means occupies its second position for restricting the rate of supplying pressurized fluid to delay operation of said piston and rack assembly to open said door until said door occupies its released position.

8. Door operating apparatus as defined in claim 7 in which, said pressurized fluid source is a pressurized air reservoir on said vehicle.

* * * * *